US005832826A

United States Patent [19]

Mack et al.

[11] Patent Number: 5,832,826

[45] Date of Patent: Nov. 10, 1998

[54] DEVICE AND METHOD FOR ACTING UPON SHEETS IN A SHEET DELIVERY SYSTEM

[75] Inventors: Richard Mack, Brühl; Bernhard Waltenberger, Mannheim; Bernd Stephan, Heidelberg, all of Germany

[73] Assignee: Heidelberger Druckmaschinen AG, Heidelberg, Germany

[21] Appl. No.: 767,957

[22] Filed: Dec. 19, 1996

[30] Foreign Application Priority Data

Dec. 20, 1995 [DE] Germany ..... 195 47 546.1

[51] Int. Cl.[6] ..... B41F 5/02

[52] U.S. Cl. ..... 101/231; 101/229; 242/419.2; 226/195

[58] Field of Search ..... 101/231, 232, 101/229, 483; 271/194, 195, 188, 183, 182; 242/419.2; 226/195

[56] References Cited

U.S. PATENT DOCUMENTS

| | | | |
|---|---|---|---|
| 3,065,892 | 11/1962 | Castelijns | 226/195 |
| 3,076,492 | 2/1963 | Monks | 101/232 |
| 3,550,556 | 12/1970 | Chawda | 118/637 |
| 3,719,169 | 3/1973 | Cade et al. | 118/636 |
| 3,975,057 | 8/1976 | Hurd | 226/195 |
| 4,002,047 | 1/1977 | MacPhee et al. | 271/183 |
| 4,013,284 | 3/1977 | Demetre | 271/183 |
| 4,384,524 | 5/1983 | Simeth et al. | 101/232 |
| 4,792,860 | 12/1988 | Kuehrie | 358/300 |
| 4,909,890 | 3/1990 | Bonnyman | 226/195 |
| 5,687,964 | 11/1997 | Stephan et al. | 271/195 |

FOREIGN PATENT DOCUMENTS

| | | |
|---|---|---|
| 0 502 417 A1 | 9/1992 | European Pat. Off. . |
| 0 695 707 A2 | 2/1996 | European Pat. Off. . |
| 20 32 046 | 1/1971 | Germany . |
| 24 07 380 | 8/1974 | Germany . |
| 33 45 201 A1 | 4/1986 | Germany . |
| 266 785 A1 | 10/1987 | Germany . |
| 29 30 619 C2 | 11/1989 | Germany . |
| 41 09 876 A1 | 10/1992 | Germany . |
| 44 27 897 C1 | 9/1995 | Germany . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

A device and a method for acting upon sheets in a sheet delivery system of a printing press, wherein sheets can be printed selectively on one side and on both sides thereof, includes a sheet tautener having a surface by which it is integrated into at least one adjacent sheet feeding plane, mounting supports for the sheet tautener, and adjacent air nozzles for forming an air cushion on the sheet tautener when the printing press is in a single-sided printing mode for printing on one side thereof and is in a first-form and perfecter printing mode for printing on both sides thereof.

11 Claims, 3 Drawing Sheets

DEVICE AND METHOD FOR ACTING UPON SHEETS IN A SHEET DELIVERY SYSTEM

BACKGROUND OF THE INVENTION

Field of the Invention

The invention relates to a device and method for acting upon sheets in a sheet delivery system of a printing press, wherein sheets can be printed selectively on one side or both sides thereof.

It has become known heretofore from German Patent DE 44 27 897 C1 to provide a device for acting upon a sheet. A sheet smoother for dewaving or removing waves which have formed in the sheets in single-sided air recto printing and a guide device for contact-free guidance of the sheets in two-sided or recto/verso printing are disclosed. The sheet smoother is mounted locally fixed on the frame of the printing press in a position which is recessed relative to the guide path of the guide device, and a guide element is provided in the form of a plate, which is movable into a free space between a sheet guide plate or baffle and the sheet smoother in order to cover the sheet smoother in two-sided printing.

To swivel the plate which covers the sheet smoother in two-sided printing, an adjusting cylinder unit is required, which is a hindrance to the replaceability of the sheet smoother, for example, for cleaning purposes. Moreover, a flat sheet feeding surface is provided only in two-sided printing; in single-sided printing, the sheet smoother forms a cavity or indentation, constituting a depression in the sheet feeding plane, which is not advantageous for the uniformity of sheet feeding.

SUMMARY OF THE INVENTION

It is accordingly an object of the invention to provide a device for acting upon sheets in a sheet delivery, the device being a sheet tautener or smoother which is integrated into the sheet feeding plane so that it can be brought into a cleaning position in a relatively simple manner and does not smear the sheets in either single-sided or first-form, i.e., recto, printing, or two-sided or first-form and perfector, i.e., recto/verso, printing.

With the foregoing and other objects in view, there is provided, in accordance with one aspect of the invention, a device for acting upon sheets in a sheet delivery system of a printing press, wherein sheets can be printed selectively on one side and on both sides thereof, comprising a sheet tautener having a surface by which it is integrated into at least one adjacent sheet feeding plane, mounting supports for the sheet tautener, and adjacent air nozzles for forming an air cushion on the sheet tautener when the printing press is in a single-sided printing mode for printing on one side thereof and is in a first-form and perfecter printing mode for printing on both sides thereof.

In accordance with another feature, the device of the invention includes another adjacent sheet feeding plane, both of the adjacent sheet feeding planes being provided with the adjacent air nozzles.

In accordance with a further feature of the invention, the adjacent sheet feeding planes are able to be acted upon by low-pressure air.

In accordance with an added feature of the invention, the sheet tautener is formed with deformation regions.

In accordance with an additional feature of the invention, the deformation regions are located opposite one another.

In accordance with yet another feature of the invention, the deformation regions are equipped with air nozzles.

In accordance with yet a further feature, the device of the invention includes a suction-air supply for applying suction to a first deformation region of the sheet tautener, and a compressed air supply for applying compressed air to a second deformation region of the sheet tautener.

In accordance with yet an added feature, the device of the invention includes another sheet feeding plane, both of the sheet feeding planes having a pressure level which is lower than pressure levels for blowing air in the first deformation region and for suction air in the second deformation region, respectively.

In accordance with yet an additional feature of the invention, the air nozzles of the deformation regions are located in a lower region of the first deformation region of the sheet tautener.

In accordance with still another feature of the invention, the mounting supports are spring-loaded snap closures with which the sheet tautener is lockable in side walls of the printing press.

In accordance with still a further feature, the device of the invention includes respective air nozzle rows subjectible to suction air and blowing air for generating, in the single-sided printing mode and in the first-form and perfector printing mode, a counter-current air flow in the sheet tautener between the deformation regions.

In accordance with still an added feature, the device of the invention includes a suction-air supply for applying suction to a first deformation region of the sheet tautener, and a blowing-air supply for applying blowing air to a second deformation region of the sheet tautener, the first deformation region being located before the second deformation region, as viewed in a direction of sheet travel.

In accordance with a concomitant aspect of the invention, there is provided a method of acting upon sheets in a sheet delivery system of a printing press, wherein sheets can be printed selectively on one side and both sides thereof, which comprises providing a sheet tautener having a surface by which it is integrated into an adjacent sheet feeding plane, and mounting supports for the sheet tautener, and flushing with adjacent nozzles an air cushion over the surface of the sheet tautener when the printing press is selectively in a single-sided printing mode for printing on one side thereof and is in a first-form and perfecter printing mode for printing on both sides thereof.

Integrating the surface of the sheet tautener with the sheet feeding plane affords a largely uninterrupted sheet transport in both single-sided printing and two-sided printing. When printing the second or perfecter side, smear-free sheet guidance can be assured by the introduction of an air cushion, without first having to swivel peripherally supporting covering elements into the feeding plane. Moreover, the bearing or mounting support of the sheet tautener, which is effected as four mounting points with snap closures, ensures problem-free swiveling away or removal of the sheet tautener with only a relatively few manipulations.

Advantageously, the air for generating an air cushion is introduced from one of the adjacent guide baffles of the sheet feeding plane. The adjacent guide baffles of the sheet feeding plane are acted upon by compressed or pressurized air at a low pressure level.

The sheet tautener according to the invention includes curved deformation regions which face one another. The deformation regions may be provided with individual air nozzles which extend in rows over the width of the sheet delivery system. One of the deformation regions of the sheet tautener is subjected to suction air, while the opposed second deformation region can be acted upon by compressed air. The pressure level for the suction and blown or blast air, respectively, for both of these deformation regions on the sheet tautener is somewhat higher than the pressure level in the sheet feeding plane.

In an advantageous construction of the concept upon which the invention is based, the air nozzles, which are embodied in rows side by side, are provided in the lower region of the first deformation region of the sheet tautener, while the row of air nozzles in the second deformation region is located somewhat higher in that region. When the deformation regions are subjected to suction or blown air, a counter-current air flow can build up as a result, so that, in the potentially smearing region, both in purely one-sided printing and in the two-sided printing mode, contact between the previously printed side of the sheet with the surfaces of the sheet tautener is prevented.

For easier replaceability, the sheet tautener is equipped with snap closures, with which it can be locked in or removed from the side walls with only a relatively few manipulations.

To create the counter-current air flow in the potentially smearing region of the sheet tautener, the first deformation region, as viewed in the sheet travel direction, is acted upon by suction air, and the second deformation region in the sheet travel direction is acted upon by blown air.

Other features which are considered as characteristic for the invention are set forth in the appended claims.

Although the invention is illustrated and described herein as embodied in a device for acting upon sheets in a sheet delivery system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
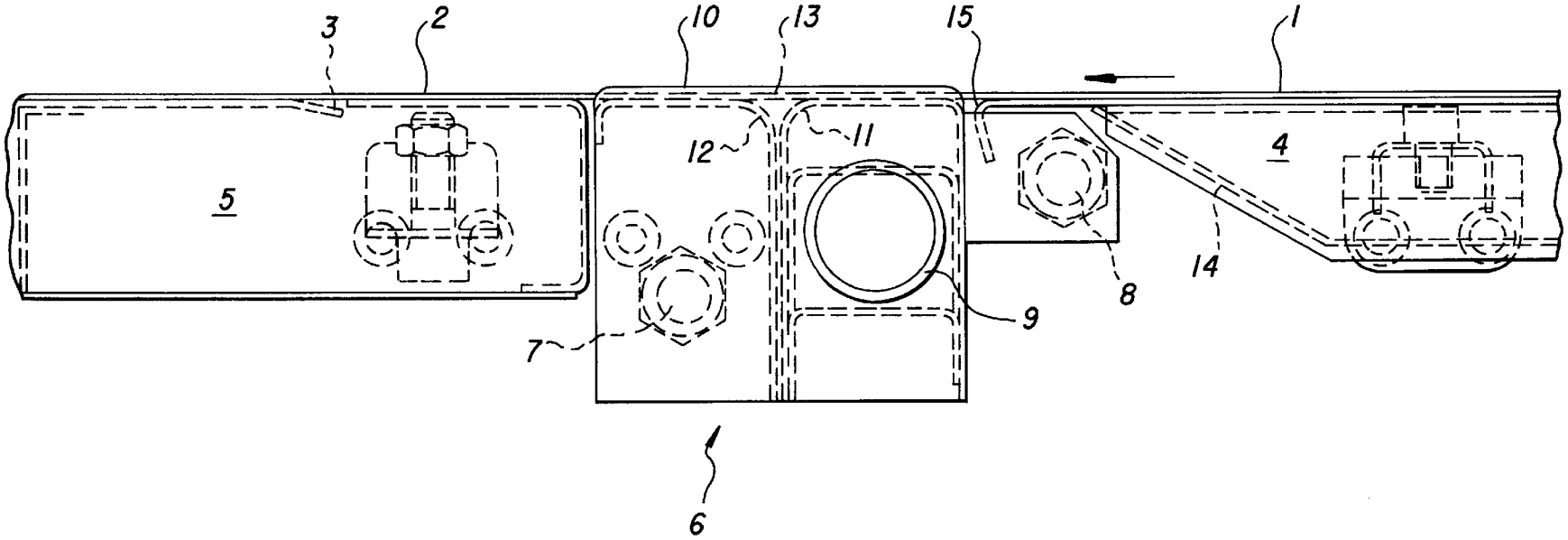
FIG. 1 is a side elevational view of a sheet smoother or tautener which is integrated into a sheet feeding plane.

Referring now to the drawings and, first, particularly to FIG. 1 thereof, there is shown therein a sheet smoother or tautener 6, which is integrated or received into a sheet feeding plane, i.e., in guide plates or baffles 1 and 2, which are equipped with air nozzles 3 for directing a multiplicity of air flows in various directions and are formed by individual profiles 14 which define hollow spaces 4 and 5. A sheet tautener 6 is supported between one edge 15 of the sheet feeding plane 1 and an opposite edge of the sheet feeding plane 2. The sheet tautener 6 is supported in non-illustrated side walls of the sheet delivery system of the printing press by means of detent bolts or mounting supports 7 and 8.

The sheet tautener 6 includes a first deformation region 11, as viewed in a sheet travel direction represented by the arrow 18, and a second deformation region 12, both of which have a curved surface. The sheet tautener 6 is laterally defined by two opposite boundary walls 10, only one of which is illustrated in FIG. 1. A connection or junction 9 is provided for an air supply to the sheet tautener 6. Between the surfaces of the deformation regions 11 and 12, which terminate at the bottom thereof, a gap is formed separating the deformation regions 11 and 12 from one another.

Figure 2:
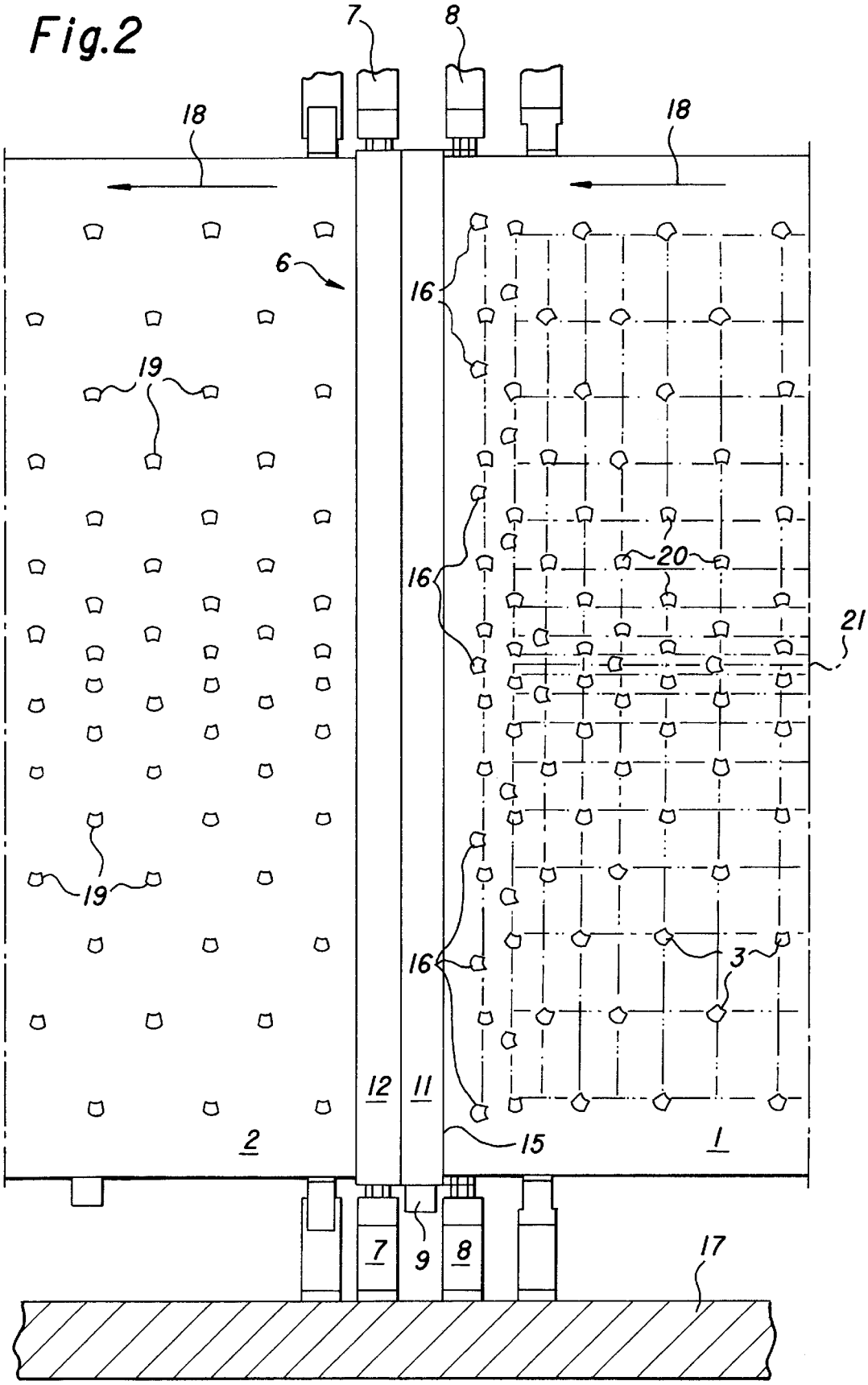
FIG. 2 is a reduced fragmentary top plan view of FIG. 1 showing deformation regions of the sheet smoother or tautener, between guide baffles forming the sheet feeding plane.

In FIG. 2, a plan view of the sheet tautener 6 received between the guide baffles 1 and 2 is provided. The guide baffles 1 and 2, likewise locked by only diagrammatically illustrated bearings in side walls 17 are provided with a multiplicity of air nozzles 3. In the first guide baffle 1, as viewed in the sheet travel direction, i.e., from the right-hand side to the left-hand side of FIG. 2, the individual nozzles are arranged symmetrically with respect to a centerline 21 of the feeding plane. Reference numeral 3 identifies a group of nozzles from which air flows emerge which are oriented in a lateral direction. The air nozzles may be arranged perpendicularly to the centerline 21 of the feeding plane or rotated from one another in a 15°, 30° or 45° orientation or, gradually, in arbitrary blowing-angle orientation increments. Reference numeral 20 identifies a group of air nozzles which produces strictly laterally oriented air flows. A first nozzle row 16 is formed on the leading edge of the guide baffle 1, opposite the first deformation region 11 of the sheet tautener 6. From the first nozzle row 16, in the cases of strictly single-sided printing and of first-form and perfector printing, respectively, i.e., if contact of the previously printed sheet underside with the stationary surfaces of the sheet tautener 6 is to be avoided, the air flow which introduces the air cushion over the deformation regions 11 and 12 of the sheet tautener 6 can emerge. Because smearing can occur, even during single-side or first-form printing, if corners become dog-eared, the introduction of an air cushion is useful even in that operating mode.

The air cushion, which is produced by the first nozzle row 16, extends as far as the guide baffle 2, at which a laterally tautening effect upon the sheets 13 to be fed is exerted by the laterally blowing nozzles 19 subjected thereat to blown air at a lower pressure level. The deformation regions 11 and 12, as viewed from above, are shown at the sheet tautener 6 received between the edges of the sheet guide baffles 1 and 2. These deformation regions 11 and 12 are each supported by two mounting supports 7 and 8, respectively, in the side walls 17 of the sheet delivery system of the printing press. The mounting supports 7 and 8 may be provided with resilient detent bolts, so that, by simply drawing the bolts inwardly, the sheet tautener 6 is released. On the other hand, the sheet tautener 6 could also be held in the position thereof by the mounting supports 7 and 8, respectively, and released by pressing from the operating side on the opposed pair of mounting supports 7 and 8 at the operating side and then simply be suspended on the outside; it is also possible for the sheet tautener 6 to be swiveled away after only two mounting supports 7 and 8, respectively, are pulled or drawn.

Figure 3:
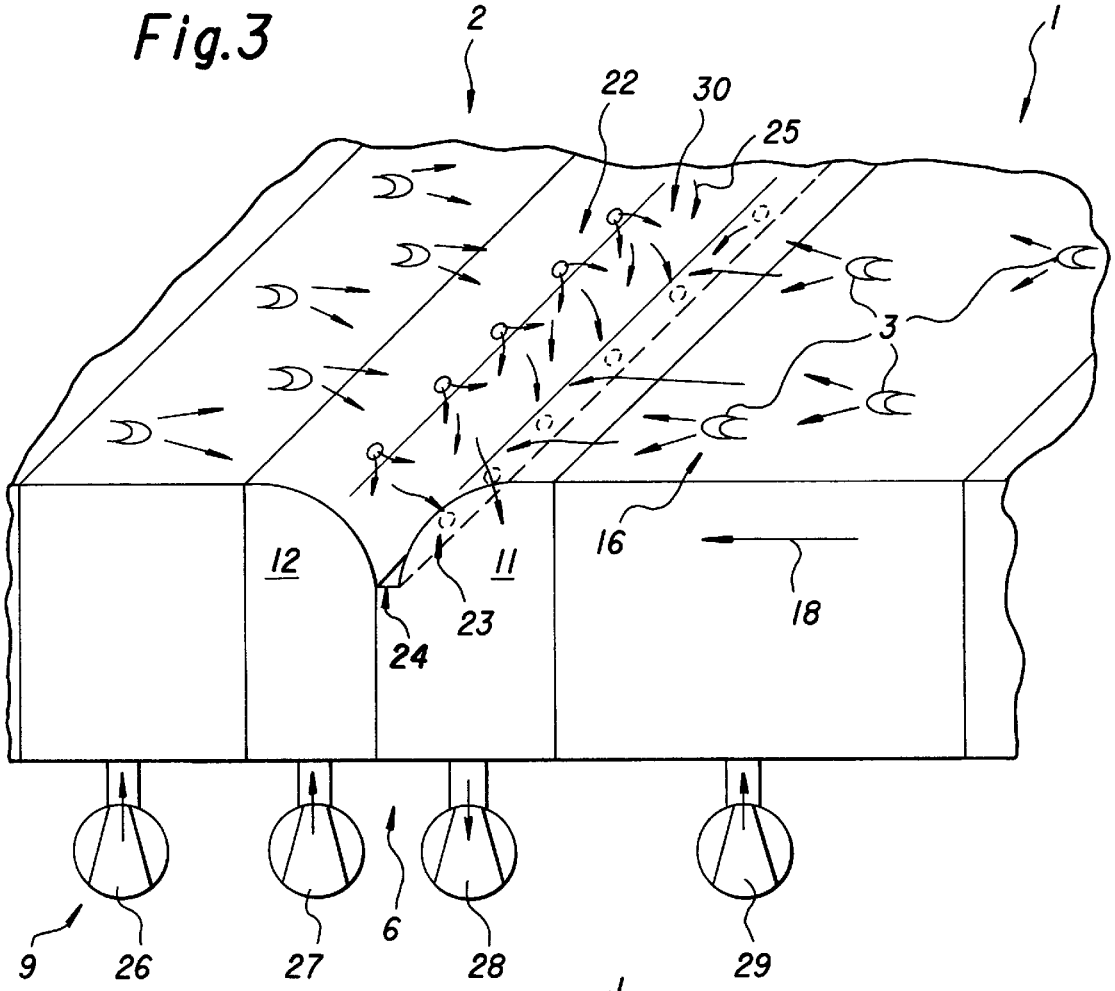
FIG. 3 is an enlarged diagrammatic, fragmentary perspective view of the sheet smoother or tautener showing air flow distribution therein with the development of a counter-current air flow in the region of potential smearing.

In FIG. 3, the flow conditions in the sheet tautener 6 and in the adjacent sheet guide baffles 1 and 2 are shown.

Both guide baffles 1 and 2 are provided with a multiplicity of air nozzles 3 oriented in various directions. Both guide baffles 1 and 2 are provided with respective blowers 26 and 29, due to which low-pressure air at a pressure level of between 5 and 20 mbar, for example, is introduced into the hollow spaces below the guide baffles 1 and 2. In contrast therewith, the deformation regions 11 and 12 of the sheet tautener 6 are acted upon by blown air and suction air, respectively, at a higher pressure level. The first deformation region 11, as viewed in the sheet travel direction 18, is subjected to suction at a negative pressure of approximately 80 mbar, for example, and is provided with a suction-nozzle row 23 in a lower region thereof. The second deformation region 12 located opposite the first deformation region 11 is provided with a blower-nozzle row 22 and is acted upon by blown air at a pressure level of between 100 and 250 mbar. The first deformation region 11, accordingly, communicates with a negative pressure source 28, and the second deformation region 12 communicates with a blower 27.

By introducing an air cushion from the lower, first nozzle row 16 of the guide baffle 1, as viewed in FIG. 2, the nip between the two deformation regions 11 and 12 is bridged, so that, in both single-sided printing and two-sided or first-form and perfecter printing, the previously-printed underside of the sheet 13 does not come into contact with the surfaces of the sheet tautener 6. In purely single-sided printing, i.e., where only one side of the sheet 13 is printed, an air cushion which supports the sheet 13 can be produced by the sheet guide baffles 1 and 2 before the sheet passes through the sheet tautener 6. Thereat, the sheet is then smoothened at the surface thereof above the gap 24 by the action of blown air represented by the arrow 25, contact of the sheet 13 with the surfaces of the deformation regions 11 and 12 being less critical; however, corners of the sheet 13 can become dogeared thereat and smearing can accordingly occur.

In contrast therewith, in perfector printing, contact of the freshly printed underside of the sheet 13 with the surfaces of the deformation regions 11 and 12 on passing through the sheet tautener 6 must be averted without limiting the effectiveness of the sheet tautener 6. To that end, the first nozzle row 16 of the guide baffle 1 generates an air cushion under the sheet 13 to be fed, this air cushion extending across both of the deformation regions 11 and 12. In addition, by subjecting the nozzle row 22 in the second deformation region 12 to blown air, and the suction nozzle row 23 in the first deformation region 11 to suction air, a counter-current air flow is created in the gap 24, which prevents the sheet 13 from dipping into the gap 24 and, accordingly, from contacting the defining surfaces thereof, in the perfecter printing mode. Thus, also no contact of the printed underside of the moving sheet 13 occurs with any stationary surface of the sheet tautener 6, and the danger that the underside of the printed sheet 13 will smear is eliminated.

Subjecting the nozzle rows 22 and 23, respectively, to blown air or suction air in strictly single-sided or recto printing is not absolutely necessary, but it can be performed if desired, so as to avoid smearing, in the case of critical paper weights per unit area, if the corners should become dog-eared.

Figure 4:
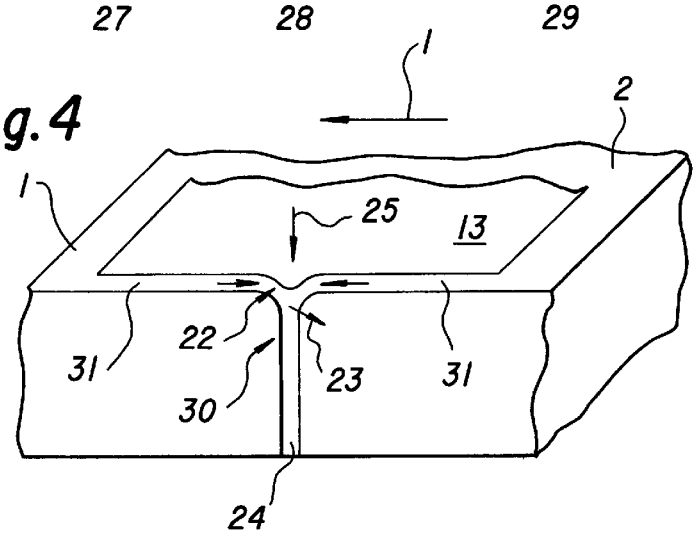
FIG. 4 is fragmentary view of FIG. 3 showing diagrammatically the deformation of a sheet passing through the sheet smoother or tautener.

FIG. 4 diagrammatically illustrates the process of sheet tautening as a sheet passes through the sheet tautener 6.

In the stage or phase represented in FIG. 4, an air cushion 31 is created under the straight or flat region of the sheet 13, above the guide baffles 1 and 2. Tautening of the sheet 13 is effected by deforming the sheet 13 with blown air directed from above, as represented by the arrow 25, when the sheet is located above the nip and the gap 24. The sheet 13 snugly adapts to the contour of the first and the second deformation regions 11 and 12 of the sheet tautener 6. By subjecting the nozzle rows 22 and 23 to blown air and suction air, respectively, the sheet 13 is prevented from dipping into the gap 24 due to the production of a counter-current air flow.

We claim:

1. A device for acting upon sheets in a sheet delivery system of a printing press, comprising:

a sheet tautener having a surface by which it is integrated into at least one adjacent sheet feeding plane, said sheet tautener also having a first deformation region and a second deformation region;

a suction-air supply for applying suction to said first deformation region of said sheet tautener, and a compressed air supply for applying compressed air to said second deformation region of said sheet tautener; and adjacent air nozzles for forming an air cushion on said sheet tautener.

2. The device according to claim 1, including another adjacent sheet feeding plane, both of said adjacent sheet feeding planes being provided with said adjacent air nozzles.

3. The device according to claim 2, including a blower supplying said adjacent sheet feeding planes with low-pressure air.

4. A device for acting upon sheets in a sheet delivery system of a printing press, comprising:

a sheet tautener having a surface by which it is integrated into at least one adjacent sheet feeding plane, said sheet tautener also having a first deformation region and a second deformation region;

a suction-air supply for applying suction to said first deformation region of said sheet tautener, and a blowing-air supply for applying blowing air to said second deformation region of said sheet tautener, said first deformation region being located before said second deformation region, as viewed in a direction of sheet travel; and adjacent air nozzles for forming an air cushion on said sheet tautener.

5. The device according to claim 1, wherein said first deformation region and said second deformation region are located opposite one another.

6. The device according to claim 1, wherein said first deformation region and said second deformation region are equipped with air nozzles.

7. The device according to claim 6, wherein said air nozzles of said first deformation region are located in a lower region of said first deformation region of said sheet tautener.

8. The device according to claim 1, including another sheet feeding plane, both of said sheet feeding planes having a pressure level which is lower than pressure levels for blowing air in said first deformation region and for suction air in said second deformation region, respectively.

9. A method of acting upon sheets in a sheet delivery system of a printing press, which comprises:

providing a sheet tautener having a surface by which it is integrated into an adjacent sheet feeding plane, the sheet tautener also having a first deformation region and a second deformation region, the first deformation region and the second deformation region forming a gap therebetween;

flushing with adjacent nozzles an air cushion over the surface of the sheet tautener; and tautening a sheet by pushing the sheet into the gap formed between the first and second deformation regions by blowing air at the sheet.

10. The device according to claim 1, including mounting supports for supporting said sheet tautener in the printing press, said mounting supports are spring-loaded snap clo sures with which said sheet tautener is lockable in side walls of the printing press.

11. The device according to claim 1, including respective air nozzle rows subjectible to suction air and blowing air for generating, in a single-sided printing mode and in a first-form and perfector printing mode, a counter-current air flow in said sheet tautener between said deformation regions.

* * * * *